US005681430A

United States Patent [19]

Neun et al.

[11] Patent Number: 5,681,430

[45] Date of Patent: Oct. 28, 1997

[54] ACTIVITY INDUCTION IN PAPERMAKING

[75] Inventors: John Neun, Clifton Park, N.Y.; Luis Fernando Cabrera y Lopez Caram, Cuernavaca, Mexico

[73] Assignees: Thermo Fibertek Inc., Waltham, Mass.; Smurfit Carton Y Papel of Mexico, Polanco, Mexico

[21] Appl. No.: 518,487

[22] Filed: Aug. 23, 1995

[51] Int. Cl.[6] ..... D21F 1/20

[52] U.S. Cl. ..... 162/355; 162/209; 162/351; 162/356

[58] Field of Search ..... 162/355, 356, 162/349, 351, 209, 352

[56] References Cited

U.S. PATENT DOCUMENTS

| | | | |
|---|---|---|---|
| 568,211 | 9/1896 | Savery . | |
| 695,753 | 3/1902 | Moore et al. . | |
| 1,623,157 | 4/1927 | Berry . | |
| 1,670,884 | 5/1928 | Erkens . | |
| 1,839,158 | 12/1931 | McDonnell . | |
| 2,092,798 | 9/1937 | Charlton . | |
| 2,095,378 | 10/1937 | Charlton . | |
| 2,124,028 | 7/1938 | Charlton . | |
| 2,128,269 | 8/1938 | Smith . | |
| 2,727,442 | 12/1955 | Hayes . | |
| 3,102,066 | 8/1963 | Justus | 162/209 |
| 3,598,694 | 8/1971 | Wiebe . | |
| 3,810,817 | 5/1974 | Arledter | 162/355 |
| 4,055,460 | 10/1977 | Buchanan | 162/209 |
| 4,306,934 | 12/1981 | Seppanen | 162/209 |
| 4,532,009 | 7/1985 | Nickerson | 162/351 |
| 4,780,184 | 10/1988 | Salovaara | 162/349 |
| 4,789,433 | 12/1988 | Fuchs | 162/352 |
| 4,838,996 | 6/1989 | Kallmes | 162/352 |
| 5,080,760 | 1/1992 | Smith et al. | 162/351 |
| 5,089,090 | 2/1992 | Hansen | 162/351 |
| 5,242,547 | 9/1993 | Corbellini et al. | 162/351 |
| 5,306,394 | 4/1994 | Meinander | 162/355 |

FOREIGN PATENT DOCUMENTS

| | | | |
|---|---|---|---|
| 1005530 | 12/1951 | France | 162/209 |
| 187711 | 7/1907 | Germany | 162/355 |

*Primary Examiner*—Karen M. Hastings

*Attorney, Agent, or Firm*—Kane, Dalsimer, Sullivan, Kurucz, Levy, Eisele and Richard, LLP

[57] ABSTRACT

The apparatus of the present invention is a papermaking machine with a forming fabric in a looped configuration. The forming fabric carries paper stock through the papermaking process. The forming fabric passes over a liquid-filled cavity which is bounded on its lower surface by a flexible non-permeable membrane. A roll with regular protrusions underneath the membrane is rotated to vertically excite the membrane, the liquid-filled cavity, and, subsequently, the paper stock in order to disperse the paper stock into a random orientation.

29 Claims, 7 Drawing Sheets

ACTIVITY INDUCTION IN PAPERMAKING

BACKGROUND OF THE INVENTION

1. Field of the Invention

The invention pertains to the induction of stock activity in paper forming.

2. Description of the Prior Art

Stock activity in the early part of a Fourdrinier table is critical to the production of a good sheet of paper. Generally, stock activity can be defined as turbulence in the fiber-water slurry on the forming fabric. This turbulence takes place in all three dimensions. Activity plays a major part in developing good formation by impeding stratification of the sheet as it is formed, by breaking up fiber flocs, and by causing fiber orientation to be random. Typically, the beneficial effect of stock activity is inversely proportional to the consistency of the sheet. That is, the effect of activity is typically enhanced if dewatering of the sheet is retarded while the activity is generated. Also, at higher sheet consistency, activity becomes more difficult to induce because the sheet becomes set and because water, which is the media in which activity takes place, becomes scarcer. Moreover, stock activity quality is inversely proportional to water removal from the sheet.

There are a number of conventional methods to promote activity. These methods are often associated with affecting rates of water removal. A table roll causes a large positive pressure pulse to be applied to the sheet resulting from water under the forming fabric being forced into the incoming nip formed by the roll and forming fabric. This positive pulse has a positive effect on stock activity by causing flow perpendicular to the sheet surface. Table rolls also generate a large negative pressure (vacuum) pulse from the exiting nip formed by the roll and forming fabric, which while enhancing activity, tends to greatly enhance sheet drainage. Moreover, table rolls are generally limited to relatively slow machines because at high speeds, the pulse amplitude becomes excessively large. Foils are also used to promote and control activity and drainage. A vacuum pulse is generated by the nip formed by the forming fabric and conventional foil as the fabric passes over the foil. Activity is generated by using a number of consecutively placed foils, encouraging a positively reinforced activity in the stock. Another type of foil (sometimes referred to as a "posi-blade") incorporates a positive incoming nip to generate a positive and negative pressure pulse. The amplitude of the pressure pulse is determined in a large part by the angle formed by the fabric and the incoming edge of the foil.

Often Fourdrinier tables are mechanically shaken to promote stock activity, especially on slower, narrower machines. While the shaking might enhance formation, mechanical restraints limit shake frequency and amplitude to the degree that it is not effective on machines producing at speeds over 1000 feet per minute and it is undesirable even on slow machines because of the mechanical wear on the machinery. An example of such shaking is disclosed in U.S. Pat. No. 1,623,157 to Berry entitled "Paper Making Machine". While the shaking might be a good way to enhance formation, it is undesirable because it is difficult and expensive to control and maintain, and generally punishing on the equipment on and around the Fourdrinier table. For papermaking in general, most activity inducing systems have the disadvantage of causing excessive drainage.

Similarly, U.S. Pat. No. 2,727,442 entitled "Apparatus for the Manufacture of Paper" to Hayes discloses an electromechanical vibrating element attached to a transverse vessel holding water, wherein the forming fabric or "Fourdrinier wire" is passed across the transverse vessel while the sheet metal floor of the vessel is being mechanically vibrated. This, however, would not appear to result in uniform turbulence across the width of the forming fabric.

U.S. Pat. No. 5,306,394 entitled "Turbulence Roll for a Web Former" to Meinander discloses an unpowered drainage roll, driven by the passing forming fabric, which includes a plurality of discs to impart vibratory movement to the inclined forming fabric during the dewatering process.

U.S. Pat. No. 4,789,433 entitled "Skimming Blade with Wave Shaped Troughs for a Papermaking Machine" to Fuchs discloses a skimming blade for removing water above a dewatered surface with is inclined and having a plurality of troughs.

Some further prior art U.S. patents in this general area include the following:

| | | |
|---|---|---|
| 5,089,090 | 4,055,640 | 1,839,158 |
| 5,080,760 | 3,598,694 | 1,670,884 |
| 4,532,009 | 2,128,269 | 695,753 |
| 4,306,934 | 2,124,028 | 568,211 |
| | 2,095,378 | |
| | 2,092,798 | |

OBJECTS AND SUMMARY OF THE INVENTION

It is an object of this invention to create stock activity in a Fourdrinier table in order to make high quality paper.

It is therefore a further object of this invention to induce activity in stock in a Fourdrinier table without creating excessive mechanical vibration in the mechanical components of the table.

It is therefore a still further object of this invention to induce activity in stock in a Fourdrinier table uniformly across the width of the forming fabric.

These and other objects are achieved by providing a Fourdrinier table and associated apparatus which uses motive force for the stock activity originating independently from the stock and the forming fabric. The motive force is coupled to the stock hydraulically via a water-filled cavity over which the forming fabric passes, the cavity being bounded on a lower side by a non-permeable or semi-permeable membrane which receives the motive force. The membrane allows energy to be transmitted to the forming fabric and paper stock while simultaneously reducing or eliminating the amount of water drained from the stock.

Subsequent high-capacity drainage devices may be used to freeze the formation created by the activity generator.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1A:
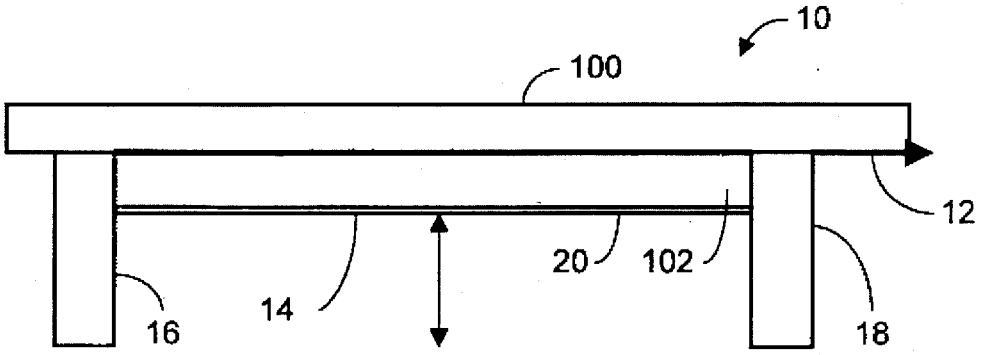
FIG. 1A is a schematic illustrating the hydraulic coupling concept of the present invention.

Referring now to the drawings in detail wherein like numerals indicate like elements throughout the several views, one sees that FIG. 1A illustrates the present apparatus 10 wherein motive force originating independently from the stock 100 and the forming fabric 12, and coupled to the paper stock 100 hydraulically via liquid 102, is used to provide for mechanical induction of the stock activity.

More specifically, a membrane or fabric 14 is stretched between stationary elements 16, 18 across the apparatus 10 for the full width of the forming fabric 12. The end walls of the membrane which are needed to hold the activity transmission water do not add stiffness to the membrane 14. Thus, the membrane 14 can vibrate uniformly across the whole width of the machine. Membrane or fabric 14 is caused to vibrate vertically under the forming fabric 12 carrying the stock 100. The tension of membrane or fabric 14 is controlled such that its resonant vibrational modes are controlled. In this regard, the membrane is tunable to correspond to the preferred frequency of activity of the stock. The resonant state of the membrane is determined (given a material and geometry of the membrane) by its tension and span. Thus, by controlling tension and span, the membrane can be made to suit particular papermaking conditions. The membrane is tensioned in the machine direction only, like a papermaking fabric. Cross-machine tension is determined by Poissons effects. The activity can be profiled across the machine by varying and controlling its tension differentially across the membrane. The membrane 14 is coupled hydraulically to the stock 100 via the forming fabric 12 by flooding the cavity 20 formed between membrane 14 and forming fabric 12 with liquid such that only incompressible media at very close to or at atmospheric pressure exists between membrane 14 and stock 100. In some applications, cavity 20 may be eliminated since the water carried inside the thickness of forming fabric 12 will provide the hydraulic coupling. However, at least a small cavity 20 is preferred to minimize or eliminate the wear of membrane 14 due to direct contact with forming fabric 12. The liquid in cavity 20 can be introduced independently or liquid from the process can be allowed to fill the cavity at start-up. Of course, the most likely liquid to be used in cavity 20 is water. It may also be possible to drain water slowly from cavity 20 between membrane 14 and forming fabric 12, as long as the coupling between the membrane 14 and forming fabric 12 is not compromised and activity is maintained.

While the membrane 14 may be such that it is impermeable to water, and therefore drainage from the stock 100 does not occur through membrane 14, in certain applications, the membrane 14 may be permeable to a desired degree to allow for drainage. Permeability can be differentially varied in the machine direction to blend activity and drainage for optimum papermaking. The desired stock activity is induced by the vibration of membrane 14 closely coupled to the stock. Again, some drainage from cavity 20 may be possible, as long as the close coupling is maintained.

Additionally, the membrane 14 can have a variable tension in the machine direction (typically no tension in the cross-machine direction) so as to tune the vibrations of the membrane 14.

Figure 7:
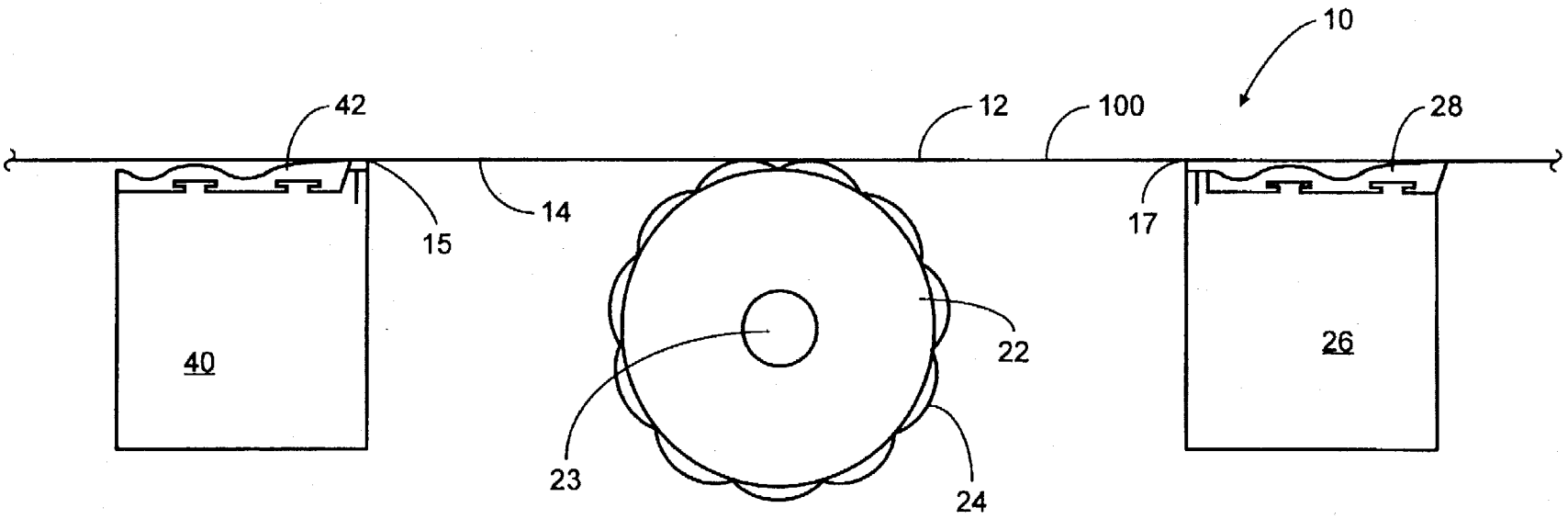
FIG. 7 is a side schematic of the apparatus of the present invention, shown with the forming fabric being free of clearance from the membrane.

As shown in FIG. 7, the membrane 14 can also be free of clearance of forming fabric 12.

Also, the length of the membrane may be modified to control a number of factors including frequency of activity and dwell time during which the forming fabric 12 is subjected to excitation.

The forming fabric 12, while having many of the characteristics of the membrane 14, is permeable to water. While it is possible with proper attention to span, tension and the resulting resonant frequency of forming fabric 12 to excite the forming fabric 12 directly without the use of membrane 14, this may result in undesired drainage through forming fabric 12.

Figure 1B:
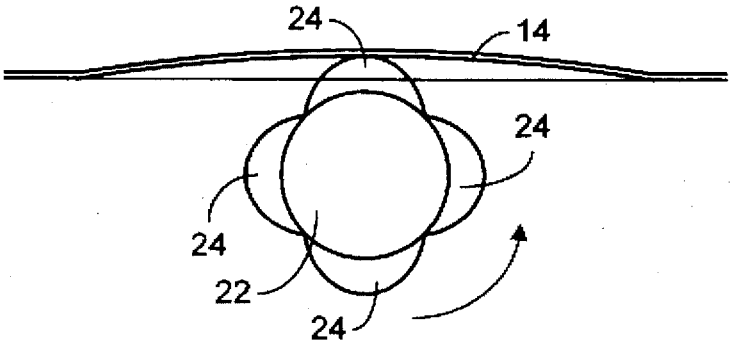
FIG. 1B is a schematic illustrating the hydraulic coupling concept of the present invention using a lobed roller.

Several methods are available to excite membrane 14. As shown conceptually in FIG. 1B, a roll 22 of irregular diameter with protrusions 24 can be oriented across a full width of membrane 14, perpendicular to the direction of travel of forming fabric 12, and made to contact membrane 14 and rotated such that protrusions 24 (i.e., the irregularities in the profile of roll 22) cause membrane 14 to be excited vertically. As roll 22 extends across the entire width of membrane 14 and has a constant profile thereacross, the excitation resulting from the rotation of roll 22 is evenly distributed across the apparatus 10 of the papermaking machine. Similarly, as the protrusions 24 are symmetric and regularly spaced circumferentially about the rotational axis of roll 22, frequency of excitation is easily controlled by the rotational speed of roll 22. Amplitude of excitation depends on the extent of the irregularity of roll 22, alternately viewed as the amplitude of protrusions 24, and position of the centerline of the roll 22 relative to the membrane 14. While the roll 22 conceptually illustrated in FIG. 1B has four lobes, the technique is applicable to any number of lobes.

Figure 2:
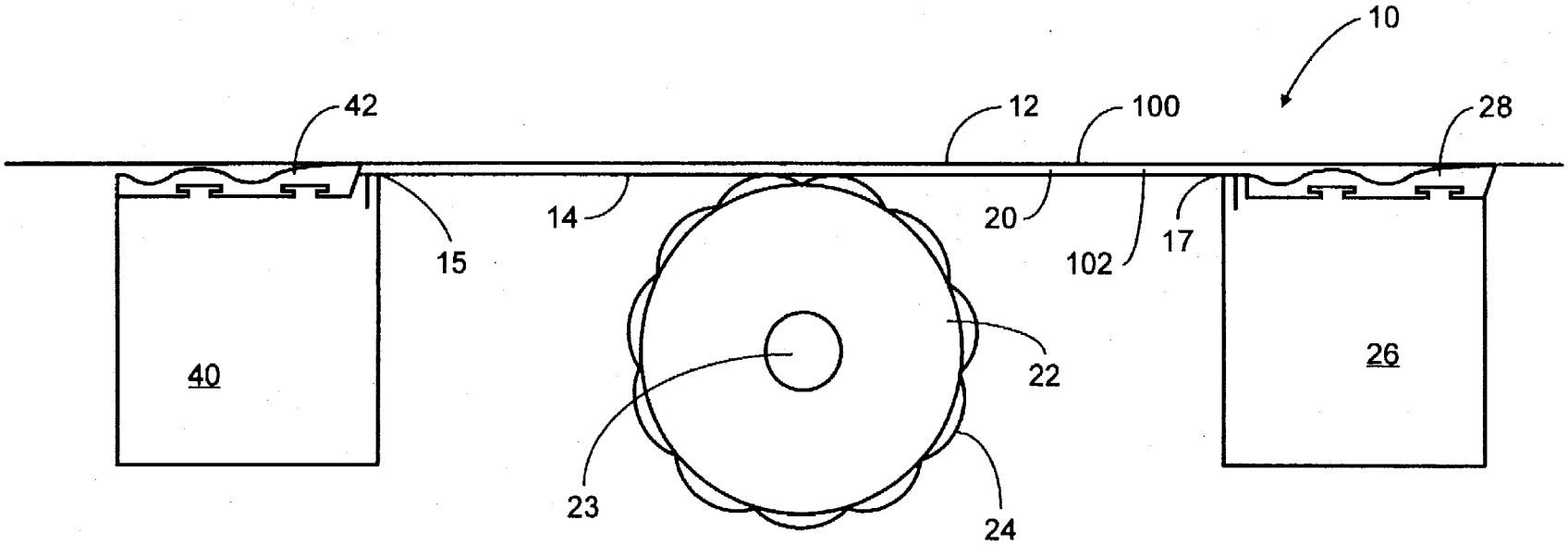
FIG. 2 is a side schematic view of the apparatus of the present invention.

FIG. 2 illustrates an embodiment where roll 22, journaled for rotation about horizontal axis 23, has many lobes or protrusions 24, and on which lobes or protrusions 24 are designed such that the displacement of membrane 14 is controlled by the profiles of lobes or protrusions 24. The vertical position of horizontal axis 23 of roll 22 is adjustable so as to allow variation in the amplitude of vibration imparted from roll 22 to membrane 14, such as may be required for different stock or paper products and as may be required for differences in the profile of roll 22. The horizontal position (in the machine direction) of horizontal axis of roll 22 is likewise adjustable.

Figure 6:
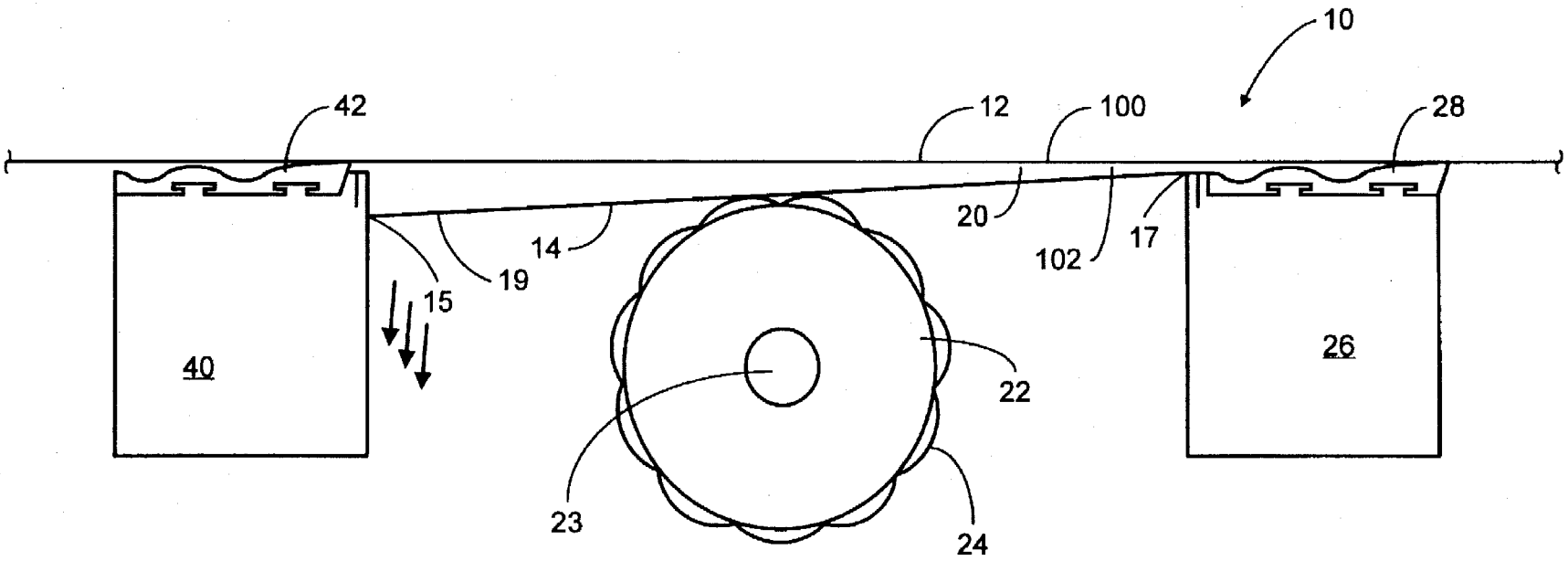
FIG. 6 is a side schematic of the apparatus of the present invention, shown with an inclined membrane bounding the lower surface of the water filled cavity.

As shown in FIG. 6, the vertical position of the ends 15, 17 of membrane 14 is adjustable so as to allow for an inclination of membrane 14 (the inclination in FIG. 6 is illustrated as exaggerated) which may have a variable permeability. Slope could be in either direction depending on paper characteristics and drainage/activity objectives.

As further seen in FIG. 2, foil 26 has a lead-in surface 28 leading to the location of membrane 14 and cavity 20. Lead-in surface 28 has a corrugated or sinusoidal shape. This sinusoidal shape has a wavelength corresponding to the wavelength of oscillation of membrane 14, so that the sinusoidal shape of lead-in surface 28 of foil 26 will complement the oscillation of membrane 14. While this may appear to be similar to the "Wonderfoil" of Kallmes, disclosed in U.S. Pat. No. 4,687,549, typically used in combination with a "Sheraton Roll", the function of the pattern of the present invention is entirely different. The function of the pattern of the present invention is to increase the kinetic energy of the suspension and to enhance the activity generated by the oscillation of membrane 14.

Alternative methods of exciting membrane 14 employ an independent actuator, such as a hydraulic or electromechanical actuator (not shown). Such a device would offer easy control of excitation amplitude as well as frequency but would be somewhat more complicated to install than roll 22. The actuator device would also have to be coupled evenly across the apparatus 10 to equal the action of roll 22. However, point excitation of membrane 14 by an actuator or series of actuators may present the opportunity to create activity variations at locations of the membrane 14 in the cross-machine direction which, under some circumstances, can be desirable.

After contacting foil 26 and roll 22, forming fabric 12 contacts member 40, which may, for example, be a drainage device, and includes lead-out surface 42 extending away from the location of membrane 14 and cavity 20. Lead-out surface 42 has a sinusoidal-shaped profile similar to that of lead-in surface 28 of foil 26.

Member 40, along with the sinusoidal lead-in and lead-out surfaces 28, 42, if used as a drainage device, can be implemented by many kinds of suction boxes, including a conventional blade drainage box or a submersible drainage box, an example of which is disclosed in U.S. Pat. No. 5,242,547 entitled "Submerged Drainage System for Forming and Dewatering a Web on a Fourdrinier Fabric" to Corbellini et al.

Figure 3:
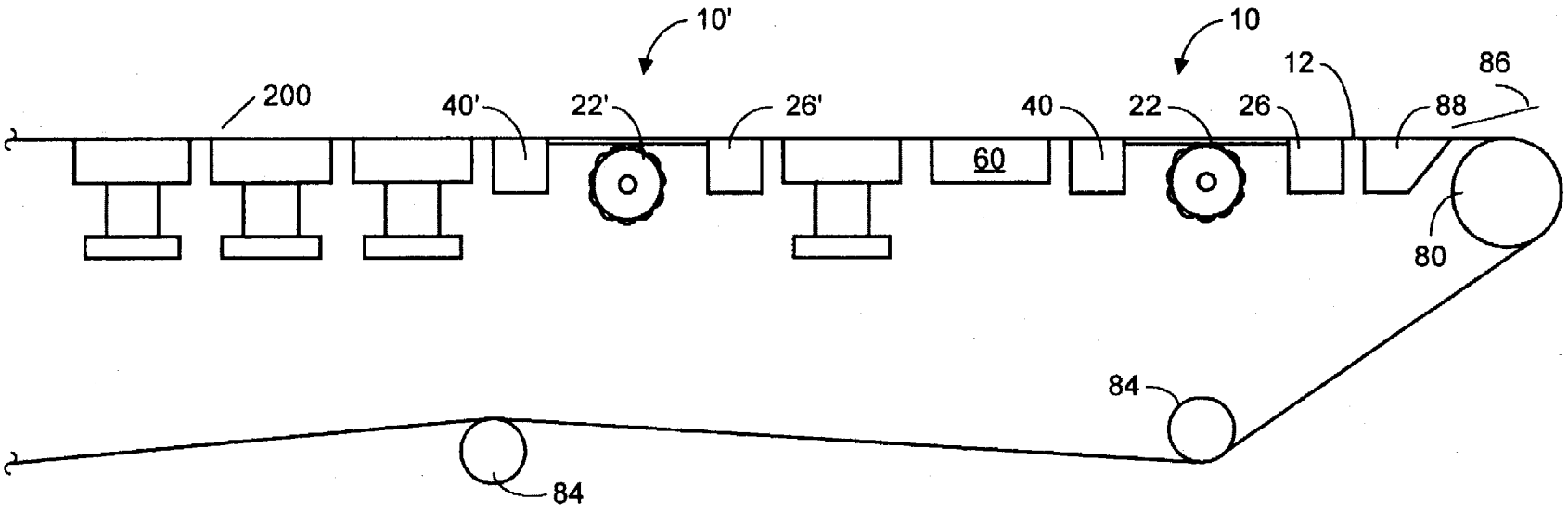
FIG. 3 is a side schematic view of the apparatus of the present invention with two activity inducing stations.

FIG. 3 shows an embodiment of the invention with a first apparatus 10 including foil 26, roll 22 driven by a rotational drive mechanism (not shown) and member 40 as described hereinabove, followed by a conventional gravity foil 60, followed in turn by a second apparatus 10' including corresponding primed elements. The rotational drive mechanism (not shown) which drives roll 22 is configured in any number of ways as appropriate as is well known in the prior art. Forming fabric 12 is configured in a loop about breast roll 80 and supported on a lower portion of the loop by idlers 84. Subsequent papermaking stations 200 are downstream from apparatus 10, gravity foil 60 and apparatus 10'.

Head box 86 provides paper stock 100 to forming fabric 12 after forming fabric 12 reaches an upright horizontal orientation downstream of breast roll 80. Forming fabric 12 is stabilized by forming board 88 and the paper stock 100 is distributed over substantially the width of forming fabric 12. As previously described, activity is induced in the stock by rolls 22, 22' which results in a random orientation of the stock and an improved quality of paper.

Figure 4:
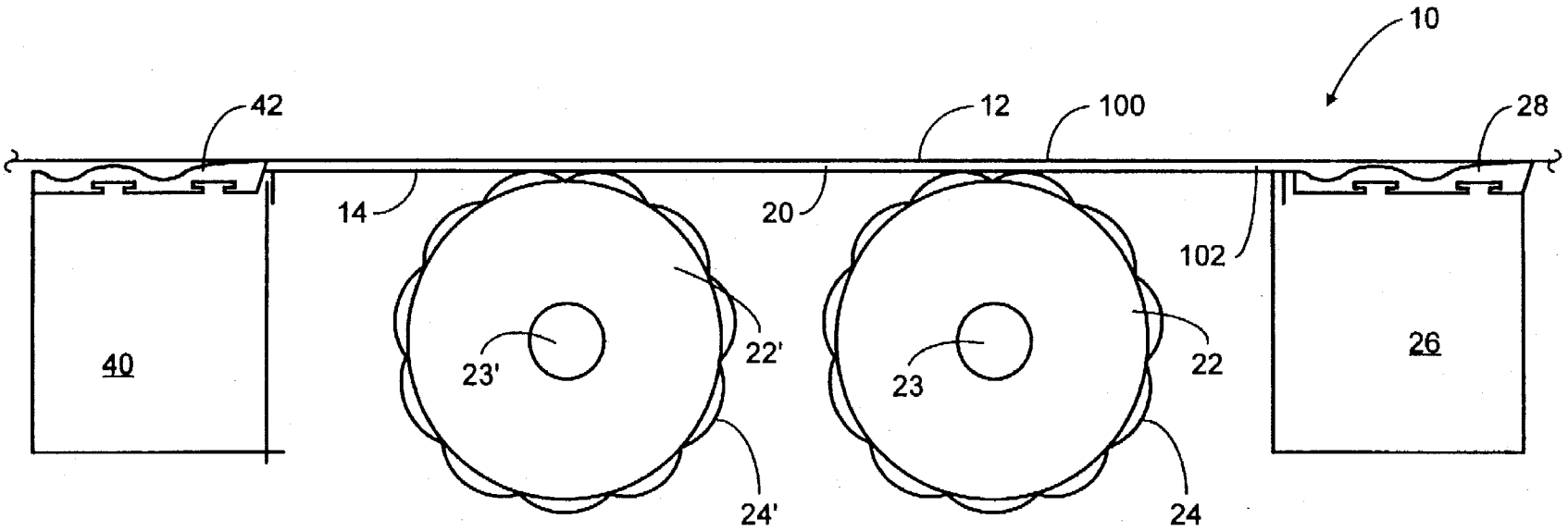
FIG. 4 is a side schematic view of the apparatus of the present invention, using two rolls in a tandem activity unit.

FIG. 4 is similar to FIG. 2 except that second roll 22' is placed to be immediately downstream from roll 22 so that rolls 22 and 22' are exciting a single membrane 14, cavity 20, forming fabric 12 and associated paper stock 100.

Figure 5:
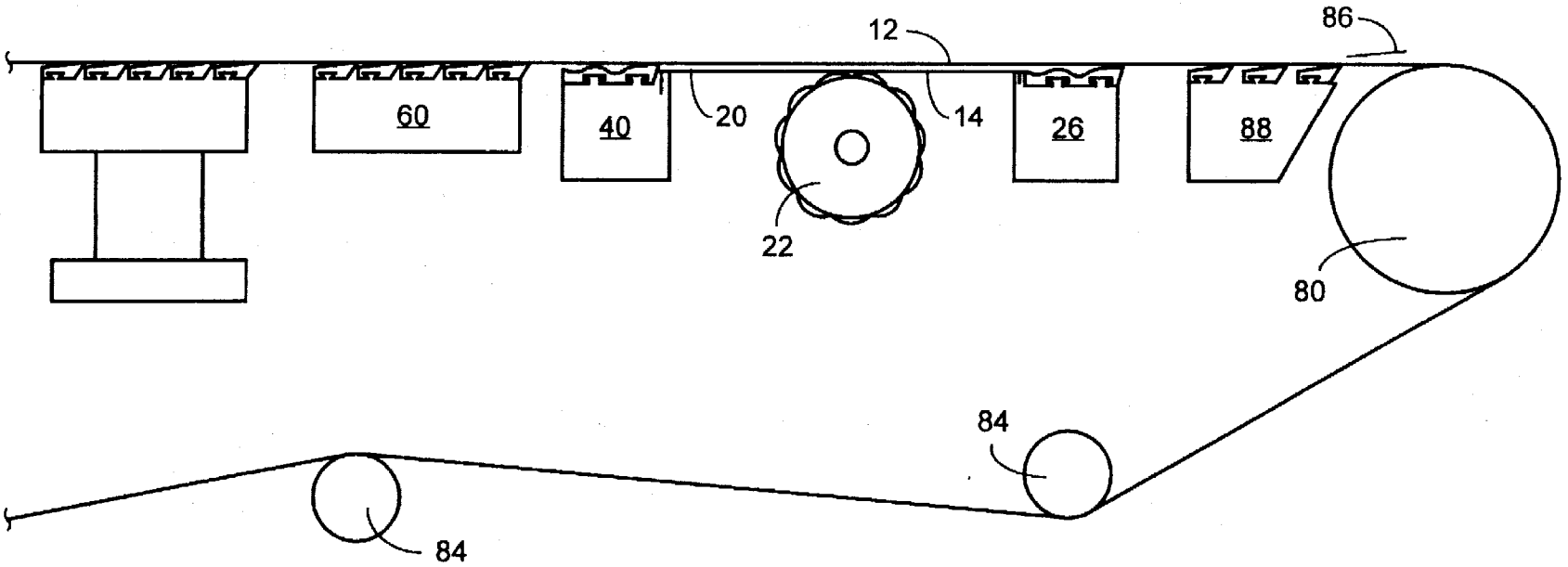
FIG. 5 is a side schematic view of the apparatus of the present invention, including the papermaking environment.

FIG. 5 shows the apparatus 10 of FIG. 2 in a papermaking environment, including gravity foil 60, breast roll 80, idlers 84, head box 86, and forming board 88, similar to the environment of FIG. 3.

As previously described, in order to use apparatus 10, the user fills cavity 20 between forming fabric 12 and membrane 14 with water. Roll 22 is rotationally activated via the rotational drive mechanism (not shown) so as to excite membrane 14. Finally, paper stock 100 is provided via head box 86 to forming fabric 12 and initially distributed at forming board 88. As forming fabric 12 traverses past roll 22, protrusions 24 periodically excite membrane 14 causing excitation of paper stock 100 via water-filled cavity 20 resulting in the desired activity and dispersal of paper stock 100.

The activity generation of the apparatus 10 (i.e., the excitation of membrane 14 by the protrusions 24 on roll 22) will create an optimum formation through controlled activity.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. In a papermaking apparatus comprising a forming fabric for transporting paper stock, a portion of said forming fabric passing over a first liquid-filled cavity bounded on a lower surface by a flexible non-rigid membrane which is spaced from the forming fabric to form said first liquid-filled cavity, and further including rotating roll means beneath said membrane for exciting said first liquid-filled cavity via said membrane to disperse the paper stock.

2. In a papermaking apparatus comprising a forming fabric for transporting paper stock, a portion of said forming fabric passing over a first liquid-filled cavity bounded on a lower surface by a fabric which is spaced from the forming fabric to form said first liquid-filled cavity, and further including rotating roll means beneath said fabric for exciting said first liquid-filled cavity via said fabric to disperse the paper stock.

3. The papermaking apparatus of claim 1 or 2 wherein said first liquid-filled cavity is filled with water.

4. The papermaking apparatus of claim 3 wherein said roll means for exciting said first liquid-filled cavity comprises means for periodically exciting said lower surface.

5. The papermaking apparatus of claim 4 wherein said roll means for periodically exciting said lower surface is oriented directly below said lower surface.

6. The papermaking apparatus of claim 5 wherein said roll means for periodically exciting includes at least one roll journaled for rotation, said roll including protrusions about a circumference thereof.

7. The papermaking apparatus of claim 6 wherein said at least one roll is journaled for rotation about a horizontal axis which is substantially perpendicular to a direction of travel of said forming fabric.

8. The papermaking apparatus of claim 7 wherein said protrusions are spaced regularly about a circumference of said at least one roll.

9. The papermaking apparatus of claim 8 wherein said apparatus includes a plurality of said rolls.

10. The papermaking apparatus of claim 6 wherein a horizontal position of a rotational axis of said roll is adjustable.

11. The papermaking apparatus of claim 6 wherein a vertical position of a rotational axis of said roll is adjustable.

12. The paper making apparatus of claim 6 wherein a horizontal and a vertical position of a rotational axis of said roll is adjustable.

13. The papermaking apparatus of claim 1 or 2 further including a second liquid-filled cavity over which said forming fabric passes and further including means for exciting said second liquid-filled cavity to disperse the paper stock.

14. The papermaking apparatus of claim 1 or 2 wherein a leading edge and a trailing edge of said first liquid-filled cavity include sinusoidal surfaces with a wavelength corresponding to an expected wavelength of oscillation of said membrane.

15. The papermaking apparatus of claim 1 or 2 wherein a leading and a trailing edge of said first liquid-filled cavity are formed as surfaces of first and second foils.

16. The papermaking apparatus of claim 1 or 2 further comprising a drainage means located beneath said first liquid-filled cavity such that water is drained from said paper stock subsequent to dispersal of the paper stock.

17. The papermaking apparatus of claim 16 wherein said first liquid-filled cavity is filled with water.

18. The papermaking apparatus of claim 17 wherein said roll means for exciting said first liquid-filled cavity comprises means for periodically exciting said lower surface.

19. The papermaking apparatus of claim 18 wherein said roll means for periodically exciting said membrane vertically is oriented directly below said membrane.

20. The papermaking apparatus of claim 19 wherein said roll means for periodically exciting includes at least one roll journaled for rotation, said roll including protrusions about a circumference thereof.

21. The papermaking apparatus of claim 20 wherein said at least one roll is journaled for rotation about a horizontal axis which is substantially perpendicular to a direction of travel of said forming fabric.

22. The papermaking apparatus of claim 21 wherein said protrusions are spaced regularly about a circumference of said at least one roll.

23. The papermaking apparatus of claim 22 wherein said apparatus includes a plurality of said rolls.

24. The papermaking apparatus of claim 16 further including a second liquid-filled cavity over which said forming fabric passes and further including means for exciting said second liquid-filled cavity to disperse the paper stock.

25. The papermaking apparatus of claim 16 wherein a leading edge and a trailing edge of said first liquid-filled cavity include sinusoidal surfaces with a wavelength corresponding to an expected wavelength of oscillation of said membrane.

26. The papermaking apparatus of claim 1 or 2 wherein said lower surface is inclined.

27. The papermaking apparatus of claim 26 wherein a lower portion of said lower surface is downstream of a remaining portion of said lower portion, and said lower portion has an increased permeability from said remaining portion of said lower surface.

28. The papermaking apparatus of claim 1 or 2 wherein said lower surface is tensioned in a direction of travel of the forming fabric, variable across said direction.

29. In a papermaking apparatus comprising a forming fabric for transporting paper stock, a portion of said forming fabric passing over a liquid-filled cavity bounded on a lower surface by a flexible non-rigid membrane which is spaced from the forming fabric to form said liquid-filled cavity, means beneath said membrane for exciting said liquid-filled cavity via said membrane to disperse the paper stock; and a leading edge and a trailing edge of said liquid-filled cavity include sinusoidal surfaces with a wavelength corresponding to an expected wavelength of oscillation of said membrane.

* * * * *